US006209169B1

(12) United States Patent
Dilger et al.

(10) Patent No.: US 6,209,169 B1
(45) Date of Patent: Apr. 3, 2001

(54) TURBINE-POWERED BRUSH NOZZLE FOR VACUUM CLEANER

(75) Inventors: Horst Dilger, Morsbach; Hans-Joachim Steudtner, Reichshof, both of (DE)

(73) Assignee: Wessel-Werk GmbH, Reichshof-Wilbergerhutte (DE)

( * ) Notice: Subject to any disclaimer, the term of this patent is extended or adjusted under 35 U.S.C. 154(b) by 0 days.

(21) Appl. No.: 09/391,572

(22) Filed: Sep. 8, 1999

(30) Foreign Application Priority Data

Oct. 30, 1998 (DE) ..... 198 50 104

(51) Int. Cl.[7] ..... A47L 9/04
(52) U.S. Cl. ..... 15/387; 15/390
(58) Field of Search ..... 15/383, 387, 389, 15/390

(56) References Cited

U.S. PATENT DOCUMENTS

| | | | | |
|---|---|---|---|---|
| 1,651,585 | * | 12/1927 | Clair | 15/390 |
| 4,776,059 | * | 10/1988 | Worwag | 15/387 |
| 5,293,665 | * | 3/1994 | Worwag | 15/387 |
| 5,331,716 | * | 7/1994 | Hemmann et al. | 15/390 |
| 6,098,243 | * | 8/2000 | Kim | 15/390 |

FOREIGN PATENT DOCUMENTS

| | | | | |
|---|---|---|---|---|
| 3414862 | * | 11/1985 | (DE) | 15/387 |
| 40 36 634 | | 5/1992 | (DE) . | |
| 42 29 030 | | 3/1994 | (DE) . | |
| 196 14 624 | | 10/1997 | (DE) . | |
| 197 06 166 | | 8/1998 | (DE) . | |

* cited by examiner

*Primary Examiner*—Terrence R. Till
(74) *Attorney, Agent, or Firm*—Herbert Dubno

(57) ABSTRACT

A vacuum-cleaner nozzle has a housing forming a turbine compartment and a brush compartment and having opening into the turbine compartment an outlet adapted for connection to a fan input and a slot opening into the brush compartment. A brush rotatable in the brush compartment has bristles projecting from the slot. A turbine in the turbine compartment is oriented such that air flow from the slot to the outlet rotates the turbine. A drive or transmission couples the turbine to the brush for rotating the brush when the turbine rotates. A button is displaceable on the housing between an outer position and an inner position and a spring urges the button into the outer position. A link between the button and the drive arrests rotation of the brush on displacement of the button into the outer position. This button is remote from the slot and the housing is formed with a handle adapted to be held by a hand of a user. The button is positioned immediately adjacent the handle for actuation by a finger of the hand on the handle.

3 Claims, 1 Drawing Sheet

TURBINE-POWERED BRUSH NOZZLE FOR VACUUM CLEANER

FIELD OF THE INVENTION

The present invention relates to a brush nozzle for a vacuum cleaner. More particularly this invention concerns a turbine-powered brush nozzle for such a cleaner.

BACKGROUND OF THE INVENTION

It is known from German patent document 4,036,634 of Fleischer, 4,229,030 of Worwag, 196 14 624 of Dilger, and 197 06 166 of Worwag as well as U.S. Pat. Nos. 4,776,059, 5,249,333, 5,293,665, and 5,920,939 to provide a power nozzle for a vacuum cleaner that has a driven brush serving to raise dirt and dust out of the object being vacuumed. Such a nozzle has a housing forming a turbine compartment and a brush compartment and having opening into the turbine compartment an outlet adapted for connection to a fan input and a slot opening into the brush compartment. The brush is rotatable in the brush compartment and has bristles projecting from the slot. A turbine in the turbine compartment is oriented such that air flow from the slot to the outlet rotates the turbine and some sort of transmission or link is provided for coupling the turbine to the brush for rotating the brush.

Rather than just having the brush rotating full time, whenever suction is applied to the outlet connection, it is known to provide some sort of element which is actuated to arrest rotation of the brush on displacement of the button into the inner position. This element normally protrudes from the bottom of the nozzle adjacent the slot so that, when the nozzle is pressed against a surface to be power vacuumed, the brush is automatically set in rotation.

The disadvantage of this system is that the brush will operate whenever the nozzle is set down right side up, potentially wearing itself out or wearing a hole in whatever it is left sitting on. Since these nozzles are mainly intended for cleaning floors, such operation is fairly logical, but if the nozzle is to be used on upholstery or drapes this type of operation can cause a problem. In addition if the user does not want to use the power-brushing feature, there is no way to disable it, for instance when vacuuming something delicate like drapes.

OBJECTS OF THE INVENTION

It is therefore an object of the present invention to provide an improved vacuum-cleaner nozzle particularly usable for upholstery and drapes.

Another object is the provision of such an improved vacuum-cleaner nozzle which overcomes the above-given disadvantages.

SUMMARY OF THE INVENTION

A vacuum-cleaner nozzle has according to the invention a housing forming a turbine compartment and a brush compartment and having an outlet opening into the turbine compartment and adapted for connection to a fan input and a slot opening into the brush compartment. A brush rotatable in the brush compartment has bristles projecting from the slot. A turbine in the turbine compartment is oriented such that air flow from the slot to the outlet rotates the turbine. A drive or transmission couples the turbine to the brush for rotating the brush when the turbine rotates. According to the invention a button is displaceable on the housing between an outer position and an inner position and a spring urges the button into the outer position. A link between the button and the drive arrests rotation of the brush on displacement of the button into the outer position. This button is remote from the slot and the housing is formed with a handle adapted to be held by a hand of a user. The link enables rotation of the brush on displacement of the button into the inner position. The button is positioned immediately adjacent the handle for actuation by a finger of the hand on the handle.

Thus with the system of this invention the user of the nozzle has control of the power-brush feature. Only when he or she actuates the button does the brush rotate. Thus the brush will not rotate when the nozzle is out of use and can even be left off when the nozzle is being used to vacuum something delicate.

The link in accordance with the invention includes a brake engageable with the turbine to arrest same in the inner position of the button. Alternately it includes means for decoupling the turbine from the brush in the inner position of the button.

It is also within the scope of this invention to provide means operated by the link that displace the turbine out of the path of the stream of air being sucked through the housing so that when thus displaced it stops. To this end the turbine is rotationally fixed but axially slidable on a shaft and movable by the button along the shaft between a working position in the stream and a standby position offset therefrom.

BRIEF DESCRIPTION OF THE DRAWING

The above and other objects, features, and advantages will become more readily apparent from the following description, reference being made to the accompanying drawing whose sole FIGURE is a partly diagrammatic vertical section through the nozzle according to the invention.

SPECIFIC DESCRIPTION

Figure 1:
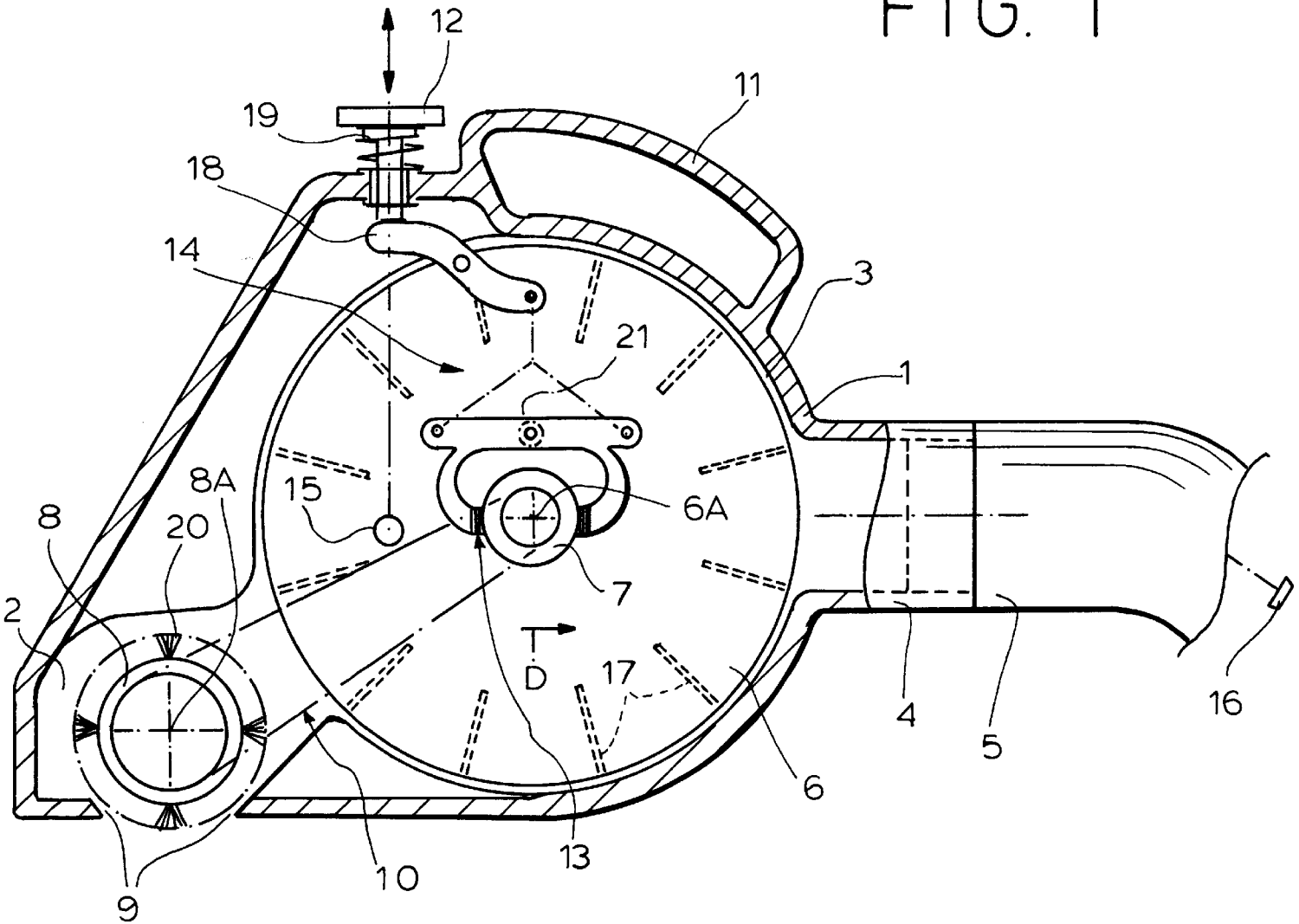

As seen in the drawing a nozzle housing 1 forms a brush chamber 2 and a turbine chamber 3 and has an outlet port or connection 4 connected via a hose 5 to the intake of a vacuum-cleaner fan shown schematically at 16. The housing 1 has on its upper wall a standard handle 11 and is formed on its bottom side with an opening or slot 9 through which bristles 20 of a brush 8 rotatable about an axis 8A project.

The turbine chamber 3 holds a turbine 6 rotatable about an axis 6A parallel to the axis 8A and having a plurality of short radially extending vanes 17 oriented such that air passing from the slot 9 to the connection 4 will urge it rotationally in the counterclockwise direction indicated at D. A transmission 10, here constituted as a flat belt, couples the turbine 6 to the roller brush 8 to rotate it so that when suction is applied by the fan 16 a portion of the kinetic energy of the air being sucked in through the slot 9 can serve to rotate the turbine 6 and brush 8.

According to the invention the turbine 6 has a hub 7 engageable by a spring-loaded double-jaw brake 14 operated through a linkage 18 by a button element 12 urged by a spring 19 into an outer position in which the brake 14 is applied to the drum 7 and inhibits rotation of the turbine 6. A torque spring 21 urges the brake 14 into the closed, rotation-impeding position. Alternately or additionally a roller 15 can be pressed against the transmission belt 10 only when the button 12 is depressed to form a releasable clutch or coupling with the turbine 6 only coupled to the brush 8 when the roller 15 is holding the belt 10 tight. Both systems serve to prevent the brush 8 from rotating unless the button

12, which is easily operated by the same hand that is holding the handle 11, is depressed, by impeding rotation of the turbine 6 with the brake 14 or decoupling the turbine 6 from the brush 8 by detensioning the belt 10 in the illustrated outer position of the button element 12.

This brush nozzle is particularly suitable for use on upholstery or drapes since it allows the user to control the brushing effect which might not be wanted when, for instance, there is the possibility of it catching on and sucking in light fabric or when the covering might be damaged by such brushing action.

We claim:

1. A vacuum-cleaner nozzle comprising:

a housing forming a turbine compartment and a brush compartment and having an outlet opening into the turbine compartment and adapted for connection to a fan input and a slot opening into the brush compartment;

a brush rotatable in the brush compartment and having bristles projecting from the slot;

a turbine in the turbine compartment and oriented such that air flow from the slot to the outlet rotates the turbine;

drive means for coupling the turbine to the brush for rotating the brush;

a button displaceable on the housing between an outer position and an inner position;

a spring urging the button into the outer position; and link means between the button and the drive means for arresting rotation of the brush on displacement of the button into the outer position and for rotation of the brush by the turbine when the button is in the inner position, the housing being formed with a handle adapted to be held by a hand of a user, the button being positioned immediately adjacent the handle for actuation by a finger of the hand on the handle.

2. The vacuum-cleaner nozzle defined in claim 1 wherein the link means includes a brake engageable with the turbine to arrest same in the outer position of the button.

3. A vacuum-cleaner nozzle comprising:

a housing forming a turbine compartment and a brush compartment and having an outlet opening into the turbine compartment and adapted for connection to a fan input and a slot opening into the brush compartment;

a handle adapted to be held by a hand of a user on the housing remote from the slot;

a brush rotatable in the brush compartment and having bristles projecting from the slot;

a turbine in the turbine compartment and oriented such that air flow from the slot to the outlet rotates the turbine;

drive means for coupling the turbine to the brush for rotating the brush;

a button displaceable on the housing immediately adjacent the handle between an outer position and an inner position;

a spring urging the button into the outer position; and link means between the button and the drive means for arresting rotation of the brush on displacement of the button into the outer position and for rotation of the brush by the turbine when the button is in the inner position.

* * * * *